US006114644A

United States Patent [19]

Nishikawa

[11] Patent Number: 6,114,644

[45] Date of Patent: Sep. 5, 2000

[54] TACT SWITCH

[75] Inventor: Kikuyoshi Nishikawa, Yokohama, Japan

[73] Assignee: Sagami Electric Co., Ltd., Yokohama, Japan

[21] Appl. No.: 09/414,067

[22] Filed: Oct. 7, 1999

[30] Foreign Application Priority Data

Jul. 28, 1999 [JP] Japan ..... 11-213690

[51] Int. Cl.[7] ..... H01K 1/10

[52] U.S. Cl. ..... 200/406; 200/533; 200/551

[58] Field of Search ..... 200/16 R–16 D, 200/17 R, 400, 402, 405–408, 431–442, 449, 520, 521, 522, 533, 551, 341, 516

[56] References Cited

U.S. PATENT DOCUMENTS

| | | | |
|---|---|---|---|
| 4,484,042 | 11/1984 | Matsui | 200/67 DB |
| 4,803,316 | 2/1989 | Hayashi et al. | 200/406 |
| 5,660,272 | 8/1997 | Janniere et al. | 200/517 |
| 6,018,132 | 1/2000 | Chen | 200/406 |

*Primary Examiner*—Michael Friedhofer
*Attorney, Agent, or Firm*—Pollock, Vande Sande & Amernick

[57] ABSTRACT

In a tact switch in which a dish-shaped movable contact piece (30) formed of a resilient material is operated to be inverted and returned to the original position within a housing to thereby make and break bridging contact between a plurality of fixed contacts plates (52) arranged on the bottom surface of the housing, the dish-shaped movable contact piece (30) is placed with the dish bottom projecting downwardly convexly toward the fixed contacts plates.

8 Claims, 9 Drawing Sheets

TACT SWITCH

BACKGROUND OF THE INVENTION

This invention relates to a tact switch having a cup-shaped movable contact.

An example of the prior art tact switch will be described below with reference to FIG. 1. The tact switch comprises a housing 10, a top lid 20 fitted in and covering the housing 10, a cup-shaped movable contact piece 30, a movable contact actuator member 40, a central fixed contact 51 and fixed contact plates 52.

The housing 10 is molded from a synthetic resin material and comprises a generally rectangular bottom plate 11, opposed end walls 12 and opposed side walls 13, the adjacent end walls 12 and side walls 13 being integrally connected together at their ends. The bottom plate 11 has an upper flat surface on which the central fixed contact 51 and fixed contact plates 52 are integrally molded and exposed. A terminal 511 is joined with and extends continually from the central fixed contact 51 and through the interior of the bottom plate 11. Terminals 521 are joined with and extend continually from the fixed contact plates 52. Each of the opposed end walls 12 has a closure tab receiving slot 121 cut down from the top edge in the center thereof. Each of the opposed side walls 13 has a broad guide window 131 cut down from the top edge in the center thereof. Each side wall 13 has mating recesses 132 formed in the outer surface thereof adjoining the opposite sides of the broad guide window 131 and communicating with and extending horizontally from the guide window 131.

The top lid 20 closing the housing 10 is made by stamping and plastically forming a thin metal sheet and comprises a cover plate 21 which forms a main body of the lid. The cover plate 21 has a mating closure tab 22 depending from each of the opposed end edges in the middle thereof. Depending from each of the opposed side edges of the cover plate 21 adjacent each of the opposite ends is an L-shaped engagement lug 23. The cover plate 21 further has a projecting tab 24 stamped out thereof in the center and bent obliquely.

The cup-shaped movable contact piece 30 is made by plastically forming a thin metal sheet such as phosphor bronze or the like having stiff resilience and has an outer peripheral lower end face 31 lying in a common plane. Reference numeral 32 is an apex region of the cup-shaped movable contact piece 30.

In this tact switch, the cup-shaped movable contact piece 30 is placed on the upper surface of the bottom plate 11 of the housing 10 with its outer peripheral lower end face 31 in contact with the exposed surfaces of the two fixed contact plates 52 and with the convex side facing upwardly. The cup-shaped movable contact piece 30 may be constructed by appropriately selecting the material and stiff resilience of the thin metal sheet of which the contact piece 30 is formed as well as by designing the geometry thereof such that downwardly directed depressing pressure applied onto the apex region 32 will flip or invert the contact piece 30 downwardly beyond the dead center (overcenter) to deform the apex region 32 so as to project downwardly convexly and that upon the downward depressing pressure being released, the contact piece 30 will flip back upwardly beyond the dead center by its own stiff resilience to spontaneously return to its original position with the apex region 32 projecting upwardly convexly.

The movable contact actuator member 40 is molded from a synthetic resin material generally in the form of a frame structure including a generally quadrilateral frame portion

41. The frame portion 41 includes two sides opposed in the pressure actuating direction as indicated by an arrow 4A, on one side of which it has an operating portion 421 which is longer than the width of the guide window 131. Two slide portions 42 are formed integrally with and extend parallel to the pressure actuating direction inwardly from the operating portion 421 adjacent its opposite ends. Integrally formed with and protruding in the pressure actuating direction outwardly from the other of the two opposed sides in the central portion thereof is a supporting extension 43. It should be noted here that the distance between the outside surfaces of the two slide portions 42 is approximately equal to the width of the guide window 131 formed through one of the side walls 13 of the housing 10 so as to permit sliding movement of the slide portions 42 through the guide window 131. Likewise, the supporting extension 43 is slidingly movable through the guide window 131 in the other side wall 13. The operating portion 421 is formed integrally with the outer ends of the slide portions 42 so as to bridge the two portions. It is seen that the opposite ends of the operating portion 421 extend slightly beyond the respective slide portions 42 perpendicularly to the length of the slide portions 42. An actuating lever 44 is formed integrally with the operating portion 421 in the central portion thereof and extends parallel to the sliding direction inwardly from the operating portion 421 between the two slide portions 42. The actuating lever 44 has an actuating protrusion 45 formed integrally therewith.

Assembly of the tact switch is performed as follows: First, the outer peripheral lower end face 31 of the cup-shaped movable contact piece 30 is brought into abutment against the upper surface of the bottom plate 11 of the housing 10 on which the fixed contact plates 52 are exposed, with the cup 30 inverted on the bottom plate 11, that is, with the cup bottom facing upward. In this state, the cup-shaped movable contact piece 30 has its outer peripheral lower end face 31 contacted with the exposed surfaces of the two fixed contact plates 52. Next, the supporting extension 43 of the movable contact actuator member 40 is fitted into the guide window 131 in the associated side wall 13 of the housing 10 while the two slide portions 42 are likewise fitted into the guide window 131 in the other side wall 13 whereby the movable contact actuator member 40 is mounted to the housing 10.

Finally, the top lid 20 is fitted and secured to the housing 10. More specifically, the mating closure tabs 22 depending from the opposed end edges of the cover plate 21 are positioned in vertical alignment with the respective closure tab receiving slots 121 formed in the opposite end walls 12 of the housing 10 while the L-shaped engagement lugs 23 depending from the opposed side edges of the cover plate 21 adjacent the opposite ends thereof are positioned in vertical alignment with the respective mating recesses 132 formed horizontally in the opposite side wall 13 adjacent the opposite ends thereof. In this state, the cover plate 21 is pressed down to cause the horizontal legs of the L-shaped engagement lugs 23 to be snapped into the respective mating L-shaped recesses 132. The downward depressing of the cover plate 21 is effected against the repulsing force of the cup-shaped movable contact piece 30 while depressing the apex region 32 of the cup-shaped movable contact piece 30 by means of the projecting tab 24 lanced and bent out of the central portion of the cover plate 21, the actuating lever 44 and the actuating protrusion 45 formed on the lower surface of the actuating lever 44 adjacent the forward end thereof.

With the thus mated and assembled tact switch in its normal state with the slide portions 42 of the movable contact actuator member 40 withdrawn from the associated guide window 131 of the housing 10, the cup-shaped movable contact piece 30 with its apex region projecting convexly upwardly is slightly downwardly biased by means of the projecting tab 24, the actuating lever 44 and the actuating protrusion 45 while the outer peripheral lower end face 31 is in contact with the upper surface of the bottom plate 11 of the housing 10 and the exposed surfaces of the fixed contact plates 52. The cup-shaped movable contact piece 30 is not in contact with the central fixed contact 51 as its apex region 32 is projecting convexly upwardly in this condition. It is thus to be understood that in the normal condition the central fixed contact 51 and the two fixed contact plates 52 are in their disengaged (OFF) position with the forward end of the actuating lever 44 adjacent to the slant surface of the projecting tab 24.

At this point, when the operating portion 421 is operated to press the movable contact actuator member 40 into the housing 10, the forward end of the actuating lever 44 is elastically displaced downwardly as it is moved in sliding engagement with the slant surface of the projecting tab 24 whereby the actuating protrusion 45 formed on the lower surface of the actuating lever 44 adjacent the forward end thereof is brought into engagement with the cup-shaped movable contact piece 30 to depress and deform the latter downwardly. The downwardly depressed deformation of the cup-shaped movable contact piece 30 is increased as the depression of the actuating protrusion 45 progresses until the actuating protrusion 45 enters into the apex region 32 of the cup-shaped movable contact piece 30 whereupon downward deformation of the cup-shaped movable contact piece 30 exceeds the dead center and the apex region 32 is flipped over or inverted downwardly into contact with the central fixed contact 51. This contact bridges the two fixed contact plates 52 and the central fixed contact 51 with the cup-shaped movable contact piece 30 to make contact therebetween. When the depressing operation on the operating portion 421 is released, the actuator member 40 is returned to its extended position under the elastic restoring force of the actuating lever 44 and the restoring force of the cup-shaped movable contact piece 30 whereupon the cup-shaped movable contact piece 30 is flipped over back to its original position to break the bridging contact between the two fixed contact plates 52 and the central fixed contact 51.

With the prior art tact switch as described above, when the operating portion 421 is in its released position, the cup-shaped movable contact piece 30 is in the position with the cup bottom facing upward such that the outer peripheral lower end face 31 is in contact with the fixed contact plates 52 and the upper surface of the bottom plate 11 of the housing 10 on which the contact plates are disposed, whereby the air is confined between the upper surface of the bottom plate 11 of the housing 10 and the cup-shaped movable contact piece 30. This air is compressed and expelled out of the cup as the collapsing deformation of the cup-shaped movable contact piece 30 progresses until it is flipped over downwardly beyond the dead center. Then, as the movable contact piece 30 is released from the depressing operation to be allowed to flip back to its original upwardly convex condition, the air is drawn in and again confined between the interior of the cup-shaped movable contact piece 30 and the upper surface of the bottom plate 11. The cup-shaped movable contact piece 30 thus expels and draws in the air each time it is flipped over downwardly and restores to its original position. During the repeated processes of expelling and drawing the air, especially while the cup-shaped movable contact piece 30 flips over from the downwardly flipped position and returns to its original condition, the drawn air may entrain with it any dust and debris present on and in the vicinity of the surface of the bottom plate 11 into the interior of the cup-shaped movable contact piece 30 and allow it to deposit on and in the vicinity of the surface of the central fixed contact 51. Such debris deposited on and in the vicinity of the surface of the central fixed contact 51 will be lodged between the central fixed contact 51 and the apex region 32 of the cup-shaped movable contact piece 30 while the movable contact piece 30 is being inverted downwardly, resulting in poor contact between the two.

SUMMARY OF THE INVENTION

It is an object of this invention to provide an improved tact switch of the type having a dish-shaped movable contact piece which is free from the adverse actions involved with the prior art dish-shaped movable contact piece such as compressing the air contained in the interior of the cup-shaped contact piece or drawing the air into the interior of the contact piece when the contact piece is depressed for operation or released to be allowed to flip back.

According to this invention, a tact switch is provided which comprises a dish-shaped movable contact piece formed of stiff resilient material which is adapted to be flipped over when operated and to be allowed, when released, to return to its original position to thereby make and break bridging contact between a plurality of fixed contacts arranged on the bottom surface of a housing, characterized in that the dish-shaped movable contact piece is placed on the bottom surface of the housing with the dish bottom projecting downwardly convexly.

DETAILED DESCRIPTION OF EMBODIMENTS OF THE INVENTION

Figure 1:
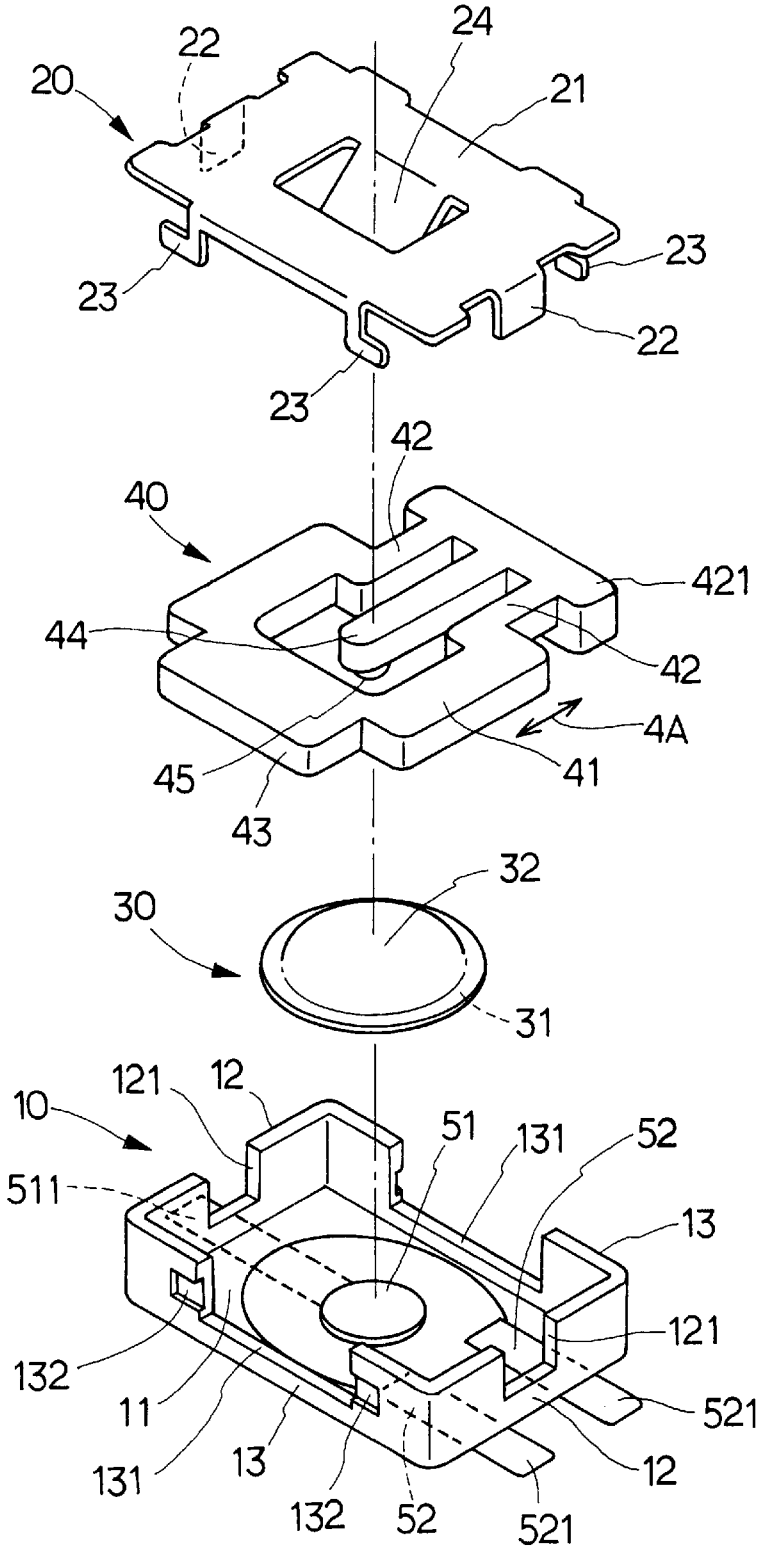
FIG.1 PRIOR ART
FIG. 1 is an exploded perspective view of a prior art tact switch.

The construction of the invention will be described with reference to an embodiment illustrated in the drawings. In the embodiment, the elements common to the example of the prior art are indicated by like reference numerals and detailed description of some of the common elements will be omitted.

Referring first to the FIGS. 2A, 2B, 2C and 2D, the housing 10 of the switch is described. In the drawings, the housing 10 is molded generally in the form of a box from a synthetic resin material and comprises a bottom plate 11, opposed end walls 12 and opposed side walls 13. The adjacent end walls 12 and side walls 13 are integrally joined together at their ends. The housing 10 has thus defined therein a movable contact accommodating cavity 10A. Integrally formed with and projecting upwardly from the bottom surface of the housing 10 (the upper surface of the bottom plate 11) in the center thereof is a movable contact support base 14 having a locating protrusion 141 extending upwardly therefrom in the center thereof. Embedded in the upper surface of the bottom plate 11 are fixed contact plates 52 extending along the respective side walls 13 from the end walls 12 toward the center and having their upper surfaces exposed. The fixed contact plates 52 terminate in outer ends extending out through the respective end walls 12 to form fixed contact terminals 521.

Figure 3A:
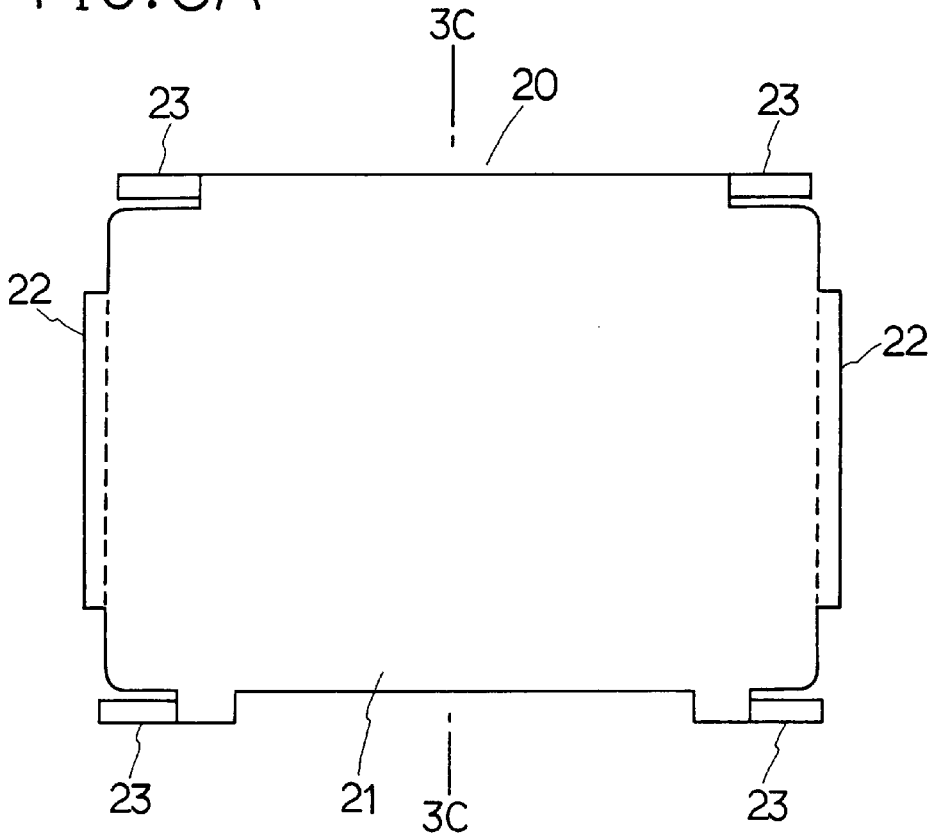
FIG. 3A is a plan view of the top lid.
Figure 3B:
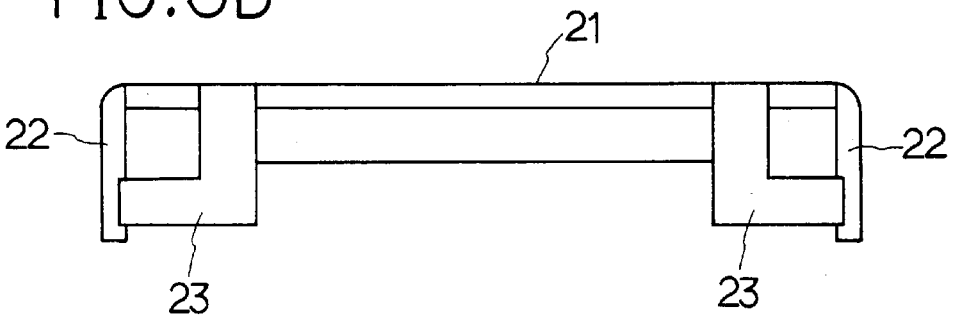
FIG. 3B is a front view of the top lid.
Figure 3C:
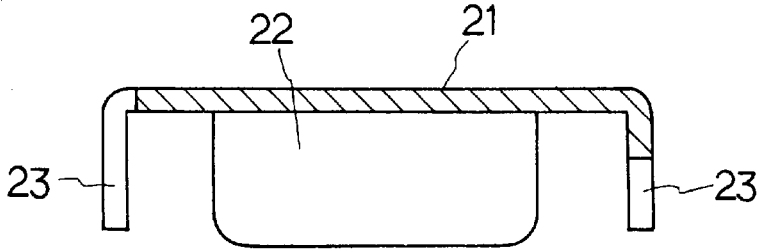
FIG. 3C is a cross-sectional view taken on line 3B—3B in FIG. 3A.

Each of the opposed end walls 12 has a wedge-like engagement portion 122 formed by cutting a notch down from the top edge of the end wall in the center thereof. The wedge-like engagement portion 122 has a lower tapered surface 12A inclined downwardly in the direction of pushing the movable contact actuator member 40 as will be described later. Mating closure tabs 22 formed on a top lid 20 as will be described below with reference to FIGS. 3A, 3B and 3C are adapted to fit in the respective closure tab receiving slots 121 formed in the end walls.

Figure 2A:
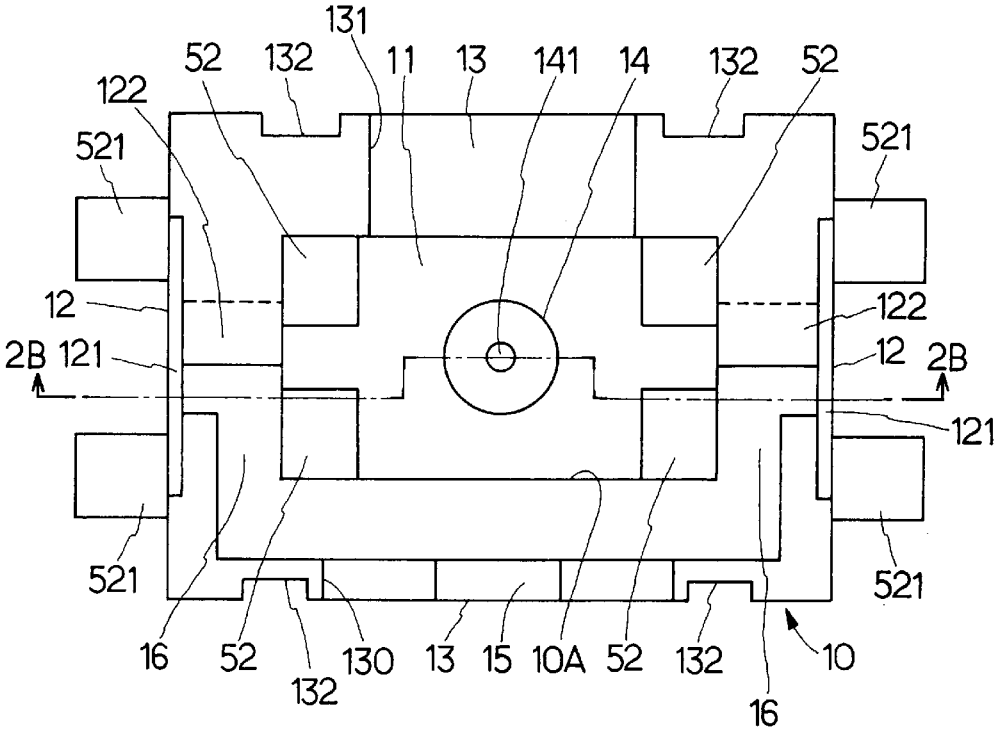
FIG. 2A is a plan view of the housing of an embodiment of the tact switch according to this invention.
Figure 2B:
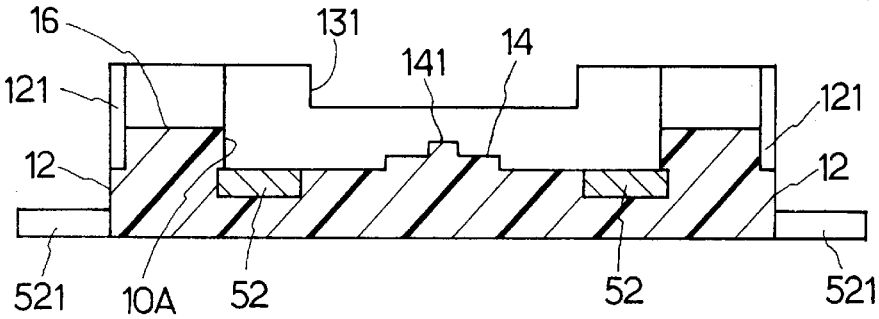
FIG. 2B is a cross-sectional view taken on line 2B—2B in FIG. 2A.
Figure 2C:
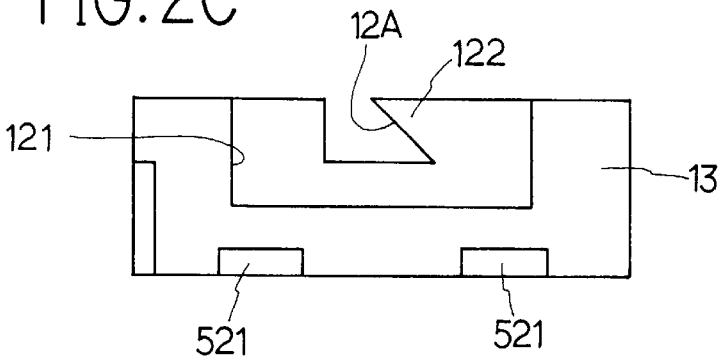
FIG. 2C is a side view as seen from the right hand side in FIG. 2A.
Figure 2D:
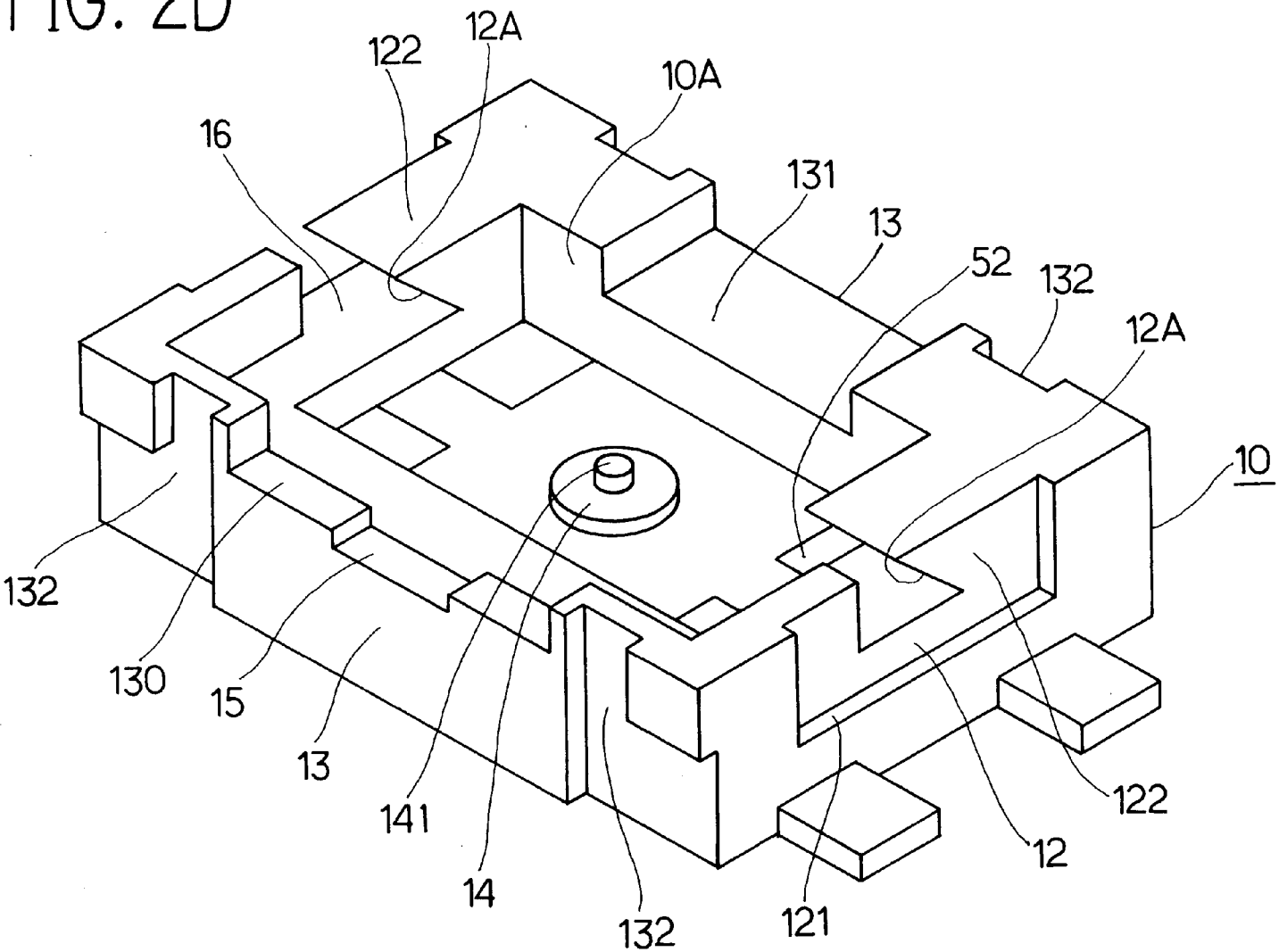
FIG. 2D is a perspective view of the housing.

One of the opposed side walls 13 has a guide window 130 cut down from the top edge in the center thereof as also shown in FIG. 2D while the other side wall 13 has a guide window 131 cut down from the top edge in the center thereof. The guide window 130 has a shallow notch 15 formed in the bottom wall thereof in the middle for slidingly receiving the bottom of a support bar 46 of the actuator member 40. The top end of the notch 15 is arranged to lie at the same elevation as the bottom wall of the guide window 130. L-shaped engagement lugs formed on the top lid 20 as will be described below are adapted to be fitted in the respective mating recesses 132. In addition, steps 16 extend from the opposite ends of that side wall 13 in which the guide window 130 is formed to and over the opposite end walls 12 integrally joined with the side wall. The difference in level between the top edges of the walls 12, 13 and the bottoms of the guide windows 130, 131 is arranged to be substantially equal to the thickness of the support bar 46 (FIG. 5B) of the actuator member 40 as will be described later with reference to FIGS. 5A and 5B. It is to be noted that the top surfaces of the steps 16 are lower than the bottoms of the guide windows 130, 131 so as to provide clearances for the actuating levers 44 to resiliently bend downward as shown in FIG. 8B.

The top lid 20 will now be described with reference to FIGS. 3A, 3B and 3C. In the drawings, the top lid 20 closing the housing 10 is made by stamping and plastically forming a thin metal sheet and includes a generally rectangular cover plate 21 which forms a principal portion of the lid. The mating closure tab 22 depends from each of the opposed end edges of the cover plate 21 in the middle thereof. The L-shaped engagement lugs 23 depends from each of the opposed side edges of the cover plate 21 adjacent each of the opposite ends thereof.

Figure 4A:
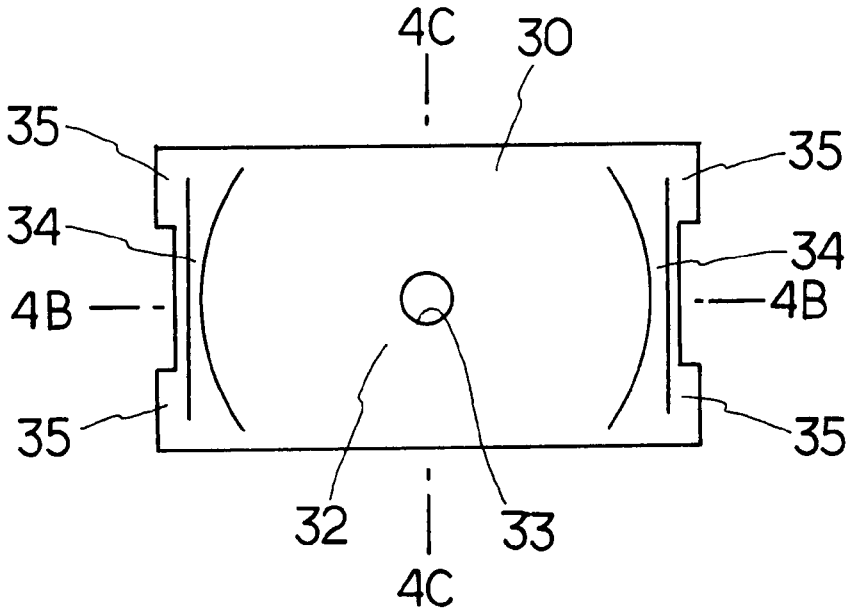
FIG. 4A is a plan view of the dish-shaped movable contact piece.
Figure 4B:
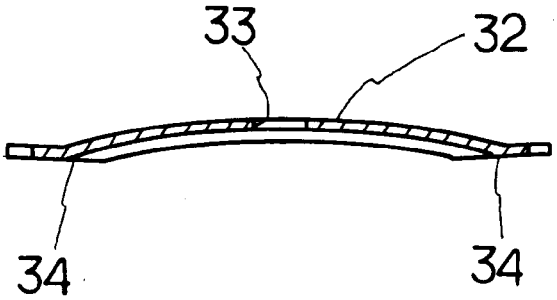
FIG. 4B is a cross-sectional view taken on line 4B—4B in FIG. 4A.
Figure 4C:
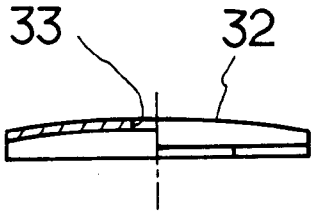
FIG. 4C is a cross-sectional view taken on line 4C—4C in FIG. 4A.

Referring to FIGS. 4A, 4B and 4C, the cup-shaped movable contact piece 30 is described below. In the drawings, the cup-shaped movable contact piece 30 is made from a rectangular thin metal sheet such as phosphor bronze or the like by plastically working on a substantial portion of the metal sheet except narrow marginal side regions 34 along the opposite minor sides of the sheet to form into the shape of a cup. The marginal side regions 34 extending along the opposite minor sides of the sheet lie in a common plane. The cup-shaped movable contact piece 30 formed of the rectangular thin metal sheet has movable contact piece contacting tabs 35 formed at its four corners. The cup-shaped movable contact piece 30 further has a central aperture 33 formed through the apex region 32 thereof.

This cup-shaped movable contact piece 30 is placed in position on the movable contact support base 14 by inserting the locating protrusion 141 of the movable contact support base 14 (FIGS. 2A, 2B) formed on the upper surface of the bottom plate 11 through the central aperture 33 with the marginal side regions 34 positioned above and the convex apex region 32 facing downwardly.

It is to be appreciated that the cup-shaped movable contact piece 30 described above may be constructed by appropriately selecting the material and stiff resilience of the thin metal sheet of which the movable contact piece 30 is formed as well as by designing the geometry thereof such that downwardly directed depressing pressure applied onto the narrow marginal side regions 34 along the opposite minor sides will flip or invert the apex region 32 upwardly beyond the dead center to deform it so as to project upwardly convexly and that upon the downward depressing pressure being released, the movable contact piece 30 will flip back downwardly beyond the dead center by its own stiff resilience to spontaneously return to its original position with the apex region 32 projecting downwardly convexly.

Figure 5A:
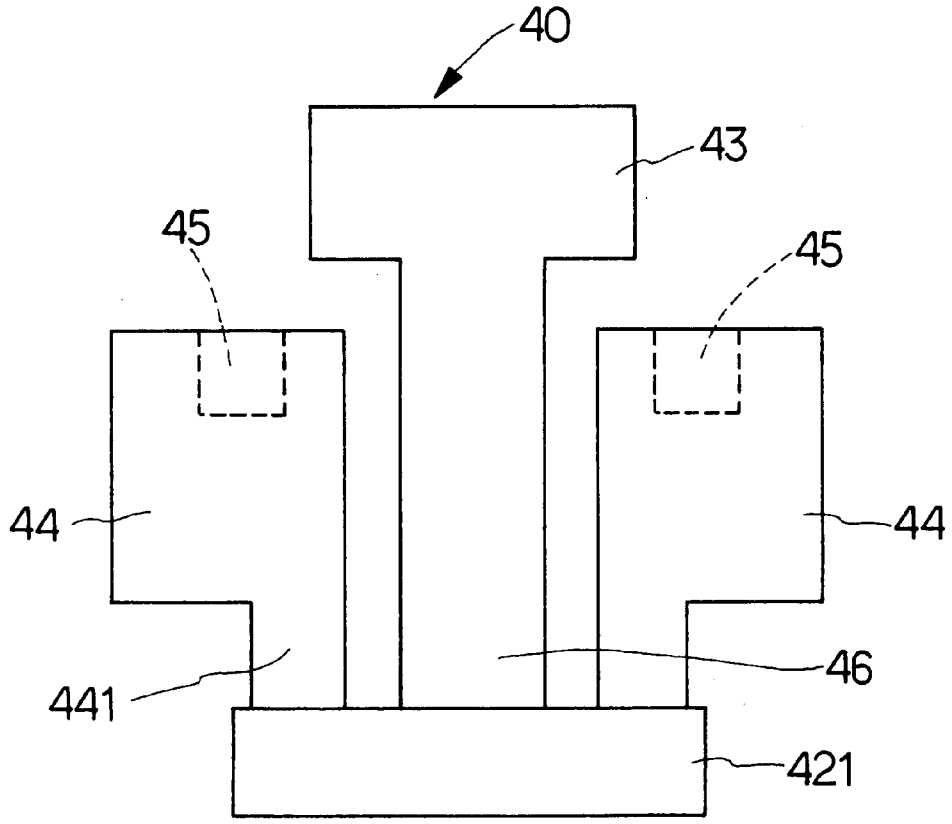
FIG. 5A is a plan view of the movable contact actuator.
Figure 5B:
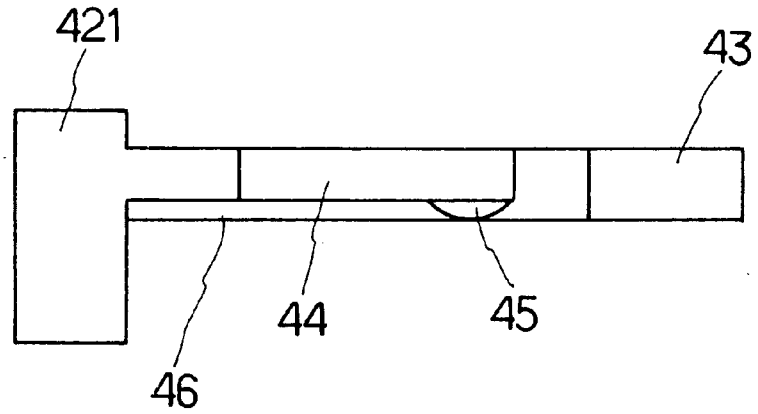
FIG. 5B is a side view of the movable contact actuator as seen from the right hand side.

Next, the movable contact actuator member 40 for drivingly pushing the movable contact piece will be described below with reference to FIGS. 5A and 5B. In the drawings, the movable contact actuator member 40 is monolithically molded from a synthetic resin material and comprises two actuating levers 44, a single support bar 46 extending between and parallel to the two actuating levers 44 and an operating portion 421 connecting the two actuating levers 44 and the single support bar 46 integrally together. The support bar 46 terminates in a forward supporting extension 43. Each of the actuating levers 44 has an actuating protrusion 45 formed on its lower surface. The roots of the actuating levers 44 comprise slide portions 441, respectively. The distance between the outside surfaces of the slide portions 441 of the two actuating levers 44 is arranged to be approximately equal to the width of the guide window 130 formed through the side wall 13 (FIGS. 2A, 2B) of the housing 10 so as to permit sliding movement of the slide portions 441 through the guide window 130 in the direction of insertion and withdrawal of the actuator member 40. The lower surface of the support bar 46 lies slightly below the lower surfaces of two actuating levers 44. With the movable contact piece 30 and the actuator member 40 assembled in the housing 10 as shown in FIG. 6B to which reference will be made in more details later, the outer portions of the forward end edges of the two actuating levers 44 are in opposing relation to the associated tapered surfaces 12A formed in the opposed end walls 12 of the housing while the actuating protrusions 45 formed on the lower surfaces of the forward end edges of the two actuating levers 44 toward the inner sides thereof are in opposing relation to the outer peripheral edges of the movable contact piece 30.

Figure 6A:
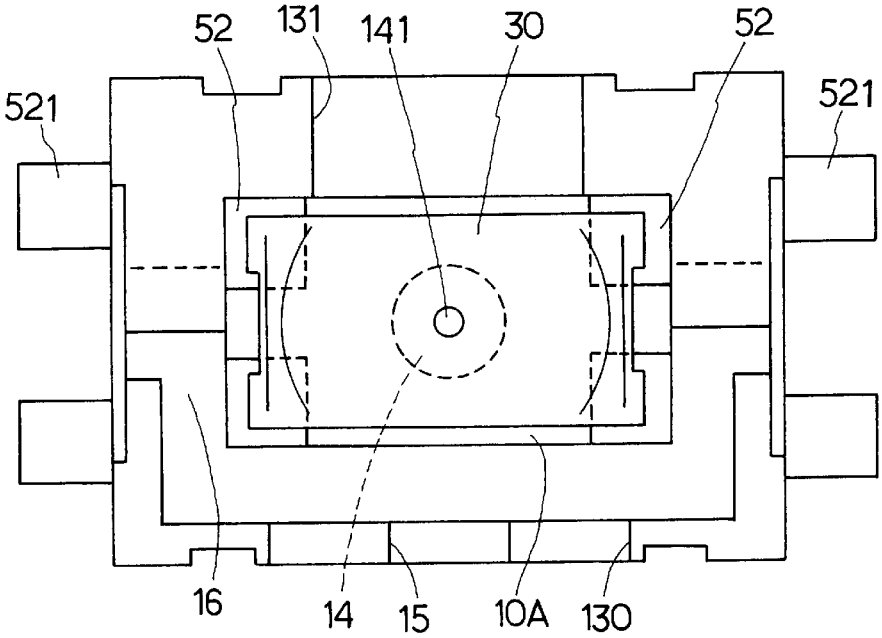
FIG. 6A is a plan view of the housing having the movable contact piece assembled therein.

How to assemble the tact switch will now be explained with reference to FIGS. 6A, 6B and 6C as well. First, referring to FIG. 6A, the cup-shaped movable contact piece 30 with the apex region projecting downwardly convexly is loosely located with respect to the movable contact support base 14 by loosely fitting the central aperture 33 thereof over the locating protrusion 141 of the movable contact support base 14 formed in the upper surface of the bottom plate 11.

Figure 6B:
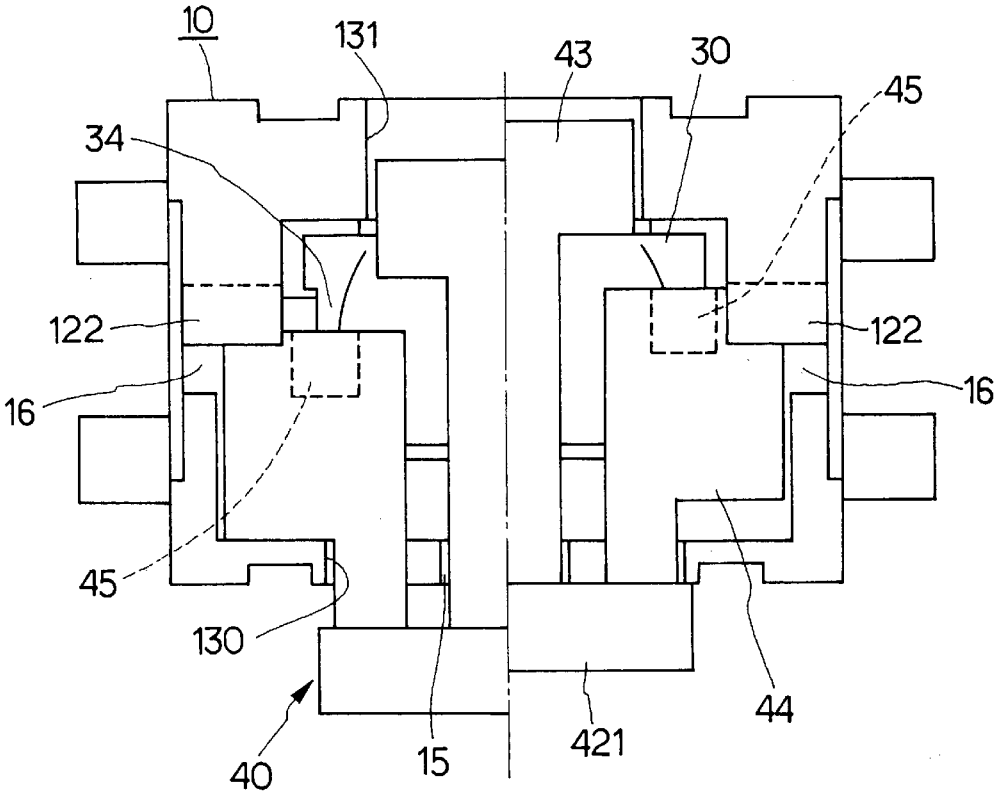
FIG. 6B is a plan view illustrating the operation of the movable contact actuator.

Next, referring to FIG. 6B, the movable contact actuator member 40 is assembled into the housing 10 having the cup-shaped movable contact piece 30 positioned with respect to the movable contact support base 14. During this operation of assembly, the support bar 46 of the movable contact actuator is located in place in the notch 15 in the bottom wall of the guide window 130 while the supporting extension 43 of the support bar 46 is located in place in the guide window 131 whereby the movable contact actuator member 40 is ultimately located in place on the bottom walls of the guide window 130 and 131.

Figure 7A:
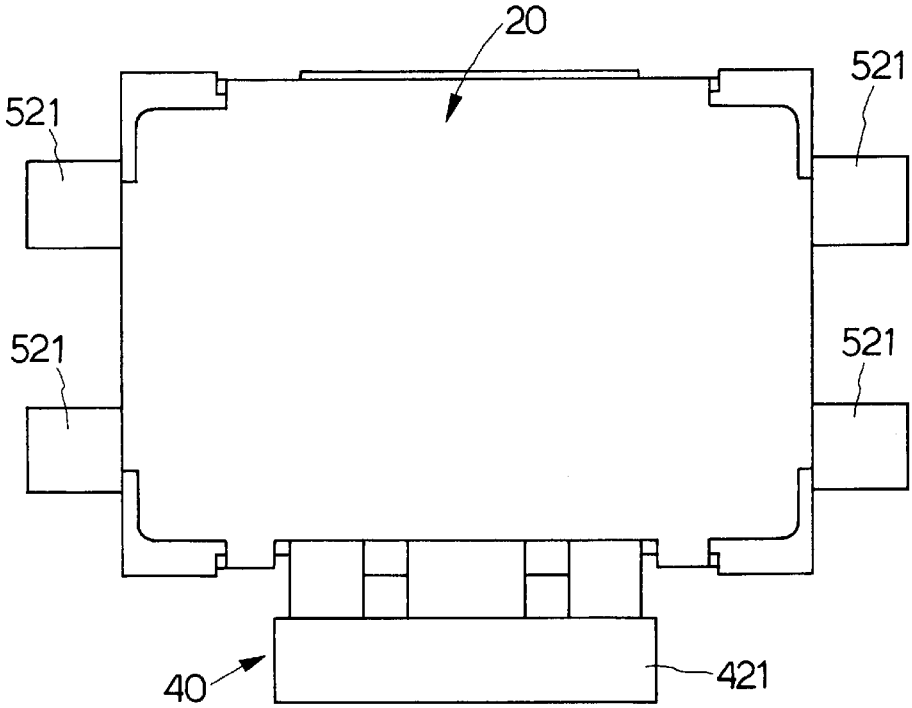
FIG. 7A is a plan view of the assembled tact switch.
Figure 7B:
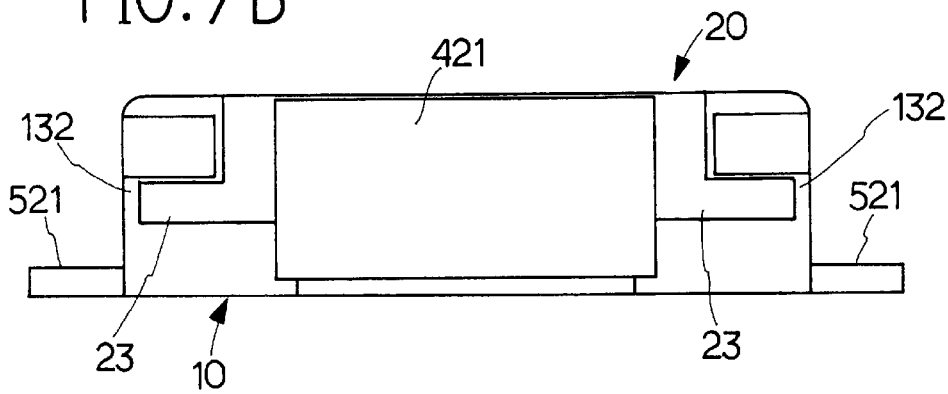
FIG. 7B is a front view of the tact switch.
Figure 7C:
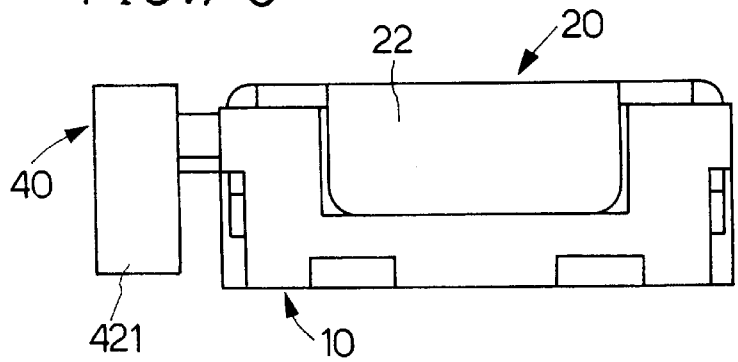
FIG. 7C is a side view of the tact switch as seen from the right hand side.

FIGS. 7A, 7B and 7C illustrate the tact switch assembled. Specifically, FIG. 7A is a top plan view of the tact switch as seen from the top lid side. FIG. 7B is a side view of the tact switch as seen from the actuator side. FIG. 7C is a side view of the tact switch as seen from the mating closure tab side.

With the movable contact actuator member 40 withdrawn to its extended position as shown on the left hand side in FIG. 6B, the top lid 20 is mated and secured to the housing 10. The securement of the top lid 20 to the housing 10 is effected by snapping the four L-shaped engagement lugs 23 into the respective mating recesses 132 formed in the side walls 13 as shown in FIG. 7B while the mating closure tabs 22 depending from the end edges of the cover plate 21 are fitted in the respective closure tab receiving slots 121 formed in the end walls 12 of the housing IO as shown in FIG. 7C.

Figure 8A:
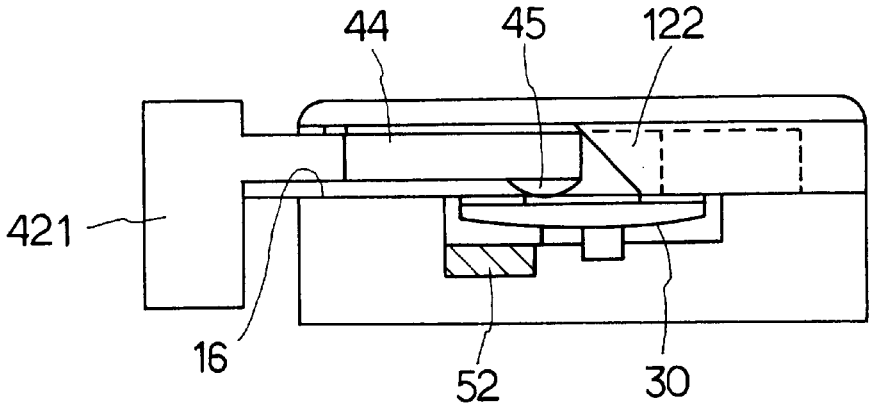
FIG. 8A is a cross-sectional view illustrating one step in the operation of the tact switch.
Figure 8B:
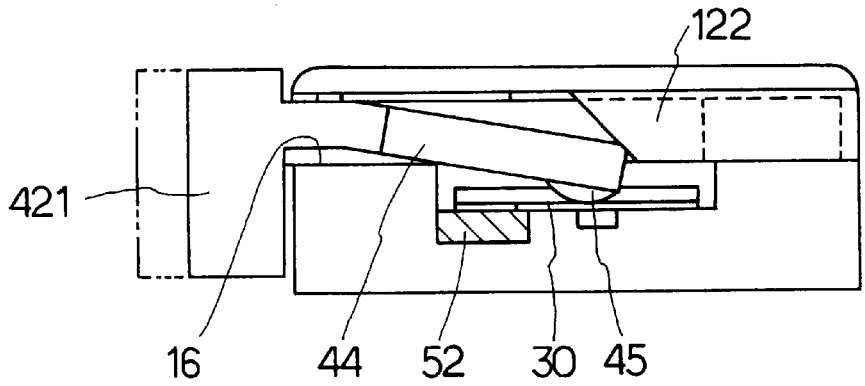
FIG. 8B is a cross-sectional view illustrating another step in the operation of the tact switch.
Figure 8C:
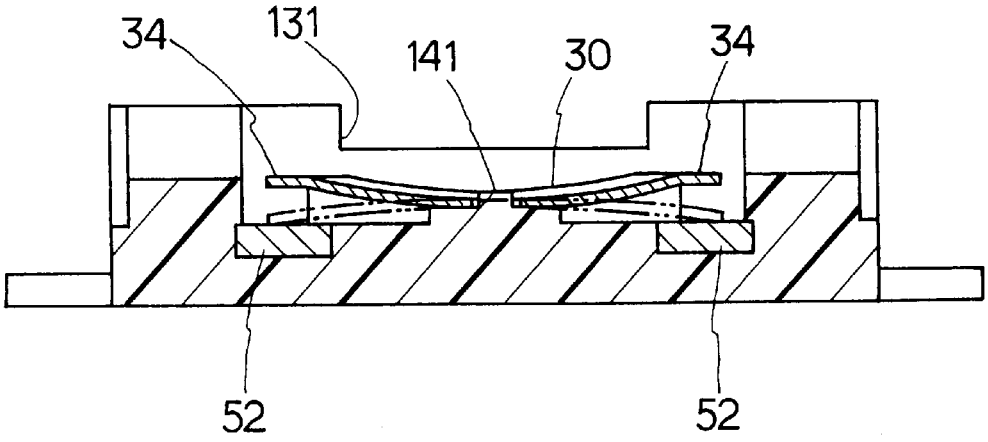
FIG. 8C is a cross-sectional view illustrating still another step in the operation of the tact switch.

Here, the assembled condition and operation of the tact switch will be further described referring to FIGS. 8A, 8B and 8C as well. FIG. 8A illustrates the switch-off (non-operative) state in which the movable contact actuator member 40 is in its withdrawn position pulled out of the housing. FIG. 8B illustrates the switch-on (operative) state in which the movable contact actuator member 40 is in its pushed-in position. FIG. 8C illustrates in what state the dish-shaped movable contact piece 30 is when the tact switch is in the switch-off and switch-on states.

Referring particularly to FIGS. 6B and 8A, in the non-operative state in which the movable contact actuator member 40 is in its withdrawn position pulled out of the housing having the top lid 20 snapped thereon, it is to be appreciated that the movable contact actuator member 40 is in a stable state by being placed on the bottom walls of the guide windows 130 and 131 and urged against them by the top lid 20. In this condition, the actuating protrusions 45 formed on the lower surfaces of the two actuating levers 44 of the movable contact actuator member 40 adjacent forward end edges thereof are merely in touch with but not pressing on the marginal side regions 34 of the movable contact piece 30. The forward end edges of the actuating levers 44 are merely in touch with but not pressing on the lower tapered surfaces of the wedge-like engagement portions 122 inclined downwardly in the direction of pushing the movable contact actuator member 40.

At this point, when the movable contact actuator member 40 together with the actuating protrusions 45 is operated to be press into the housing 10, the actuating levers 44 with their forward ends in engagement with the tapered surfaces of the wedge-like engagement portion 122 are progressively depressed downwardly along the tapered surfaces and bent downwardly. As a result, the downwardly depressed deformation of the cup-shaped movable contact piece 30 is increased as the depression of the actuating protrusions 45 progress until the actuating protrusions 45 press down on the marginal side regions 34 of the cup-shaped movable contact piece 30 so that the downward deformation of the cup-shaped movable contact piece 30 exceeds the dead center whereupon the marginal side regions 34 are flipped over-center or inverted downwardly whereby the movable contact piece contacting tabs 35 at the opposite ends of the side regions 34 are brought into contact with the fixed contact plates 52 embedded in the upper surface of the bottom plate 11 and exposed upwardly. This contact bridges across the four fixed contact plates 52 by means of the cup-shaped movable contact piece 30. When the pushing operation on the movable contact actuator member 40 is released, the cup-shaped movable contact piece 30 is flipped over back to its original position to break the bridging contact between the four fixed contact plates 52.

It should be understood that while the cup-shaped movable contact piece 30 is illustrated as being formed of thin metal sheet in the embodiment described above, the contact piece may be made of electrically conductive rubber or electrically conductive plastic. It should also be understood that the external shape of the cup-shaped movable contact piece 30 may be circular or of any other suitable form instead of rectangular.

EFFECTS OF THE INVENTION

From the foregoing description, it can be seen that by adopting the arrangement in which the dish-shaped movable contact piece 30 is positioned with respect to the bottom wall of the housing with the bottom of the dish projecting downwardly convexly and is adapted to be deformed to flip overcenter into contact with the fixed contact plates 52. This invention originally employs no central fixed contact, thereby inherently eliminating the risk of allowing dust and debris to deposit on and in the vicinity of the surface of the central fixed contact which may result in poor contact between the cup-shaped movable contact piece and the central fixed contact. In this regard, it should be noted that when the dish-shaped movable contact piece 30 positioned in place with the dish bottom projecting downwardly convexly is deformed to flip overcenter into contact with the fixed contact plates 52, the dish-shaped movable contact piece 30 is compressively deformed into contact with the surfaces of the fixed contact plates 52. It is thus to be appreciated that repetition of such contacting motions allow for self-cleaning of the contacting surfaces of the movable contact piece and the fixed contact plates, eliminating the possibility of occurrence of poor contact.

Formation of the movable contact support base 14 in the center of the bottom plate 11 to fix the dish-shaped movable contact piece 30 in place facilitates the assembly of the components to the housing 10 subsequent to assembling the dish-shaped movable contact piece 30.

In addition, forming a central aperture 33 through the center of the apex region 32 of the dish-shaped movable contact piece 30 while providing a locating protrusion 141 upstanding from the movable contact support base 14 further facilitates positioning and fixing the dish-shaped movable contact piece 30 in place to the bottom plate 11 of the housing 10.

It should also be appreciated that the construction of the movable contact actuator member 40 comprising two actuating levers 44, a single support bar 46 extending between and parallel to the two actuating levers 44 and terminating in a supporting extension 43, and an operating portion 421 connecting the two actuating levers 44 and the single support bar 46 integrally together provides for deforming the dish-shaped movable contact piece 30 in balance to effect the inversion of the dish-shaped movable contact piece 30 in an appropriate manner by maneuvering the dish-shaped movable contact piece 30 by means of the two actuating levers 44.

Moreover, it should be noted that the cup-shaped movable contact piece 30 is formed in the shape of a cup by plastically working on a rectangular thin metal sheet except marginal side regions 34 along the opposite minor sides of the sheet. It is on these linear, substantially flat marginal side regions 34 of the cup-shaped movable contact piece 30 that the two actuating levers 44 are operated to press, whereby the uniform balanced pressing operation of the movable contact actuator member 40 is ensured. It will also be appreciated that the use of a thin metal sheet as a material of which the cup-shaped movable contact piece 30 is constructed allows for providing a tact switch not only easy to manufacture due to ease of working the metal but also having a good click feeling.

What is claimed is:

1. A tact switch comprising:

a housing made of a synthetic resin material and having a bottom plate, opposed end walls formed along first opposed sides, respectively of said bottom plate, and opposed side walls formed along second opposed sides, respectively of said bottom plate;

a movable contact support base formed on the bottom plate of said housing in a center thereof;

a plurality of fixed contact plates disposed on the bottom plate of said housing in spaced relation to each other around said movable contact support base and having ends thereof extending out of said housing;

a movable contact piece having a central portion thereof placed on said movable contact support base within said housing and having a curved surface projecting downwardly convexly toward the bottom surface of said housing, said curved surface being elastically invertible with respect to a convex side;

an actuator member having a first end portion slideably inserted in said housing and a second end portion extending out of said housing; and a lid closing a top of said housing, whereby as said actuator member is slidingly moved toward an interior of said housing, said first end portion is brought into engagement with an outer peripheral portion of said movable contact piece to depress said outer peripheral portion toward the bottom plate of said housing so that said movable contact piece is inverted such that the convex side of said curved surface faces upward whereby the outer peripheral portion of said movable contact piece is brought into contact with said plurality of fixed contact plates to establish electrical connection.

2. The tact switch of claim 1 wherein, said movable contact support base is formed to project higher than the bottom plate of said housing.

3. The tact switch of claim 2 wherein, said movable contact support base has a locating protrusion upstanding from a central portion of a top surface of said base, said movable contact piece having an engagement aperture extending through a center thereof, said locating protrusion being engageable in said engagement aperture to position said movable contact piece in place.

4. The tact switch of claim 1 wherein, said opposed side walls each have guide windows formed therein for slideably guiding said actuator member which is inserted from one of said guide windows into and through the interior of said housing and projecting through the other guide window out of the housing, said opposed end walls each having engagement tapered surfaces formed therein, said tapered surfaces inclining so as to be progressively closer to the bottom plate of said housing in a direction of insertion of said actuator member, said actuator member including two actuating levers having forward end portions engageable with said associated tapered surfaces within said housing, whereby as said actuator member is inserted into and through said housing with the forward end portions of said two actuating levers in engagement with said tapered surfaces, said actuating levers are elastically bent toward said bottom plate to depress the outer peripheral portion of said movable contact piece toward said bottom plate.

5. The tact switch of claim 4 wherein, said actuator member includes a support bar extending between and parallel to said two actuating levers and slidingly guided by said guide windows formed in said side walls, and a connecting portion connecting ends of said two actuating levers and one end of said support bar outside of said housing.

6. The tact switch of claim 1 wherein, four of said plurality of fixed contact plates are provided one at each of four corners of said housing, said movable contact piece being generally rectangular with four corners opposing said corresponding fixed contact plates.

7. The tact switch of claim 1 wherein, said lid is made by stamping and bending a thin metal sheet and comprises a top plate closing a top opening of said housing, end plates depending downwardly from first opposed sides of said top plate and embracing the opposed end walls of said housing, and L-shaped engagement lugs extending downwardly from second opposed sides of the top plate adjacent the opposite ends thereof and being engageable in corresponding L-shaped recesses formed in surfaces of said opposed side walls of said housing adjacent opposite ends thereof.

8. The tact switch of claim 1 wherein, said movable contact piece is made from a rectangular thin metal sheet by plastically working on a metal sheet except narrow marginal side regions along opposed sides of the sheet to form into the shape of a cup.

* * * * *